US009089022B2

(12) United States Patent
Chen

(10) Patent No.: US 9,089,022 B2
(45) Date of Patent: Jul. 21, 2015

(54) LIGHT ADJUSTING DEVICE WITH SWITCHING ELEMENT

(71) Applicant: Lextar Electronics Corporation, Hsinchu (TW)

(72) Inventor: Po-Shen Chen, Hsinchu (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 14/179,581

(22) Filed: Feb. 13, 2014

(65) Prior Publication Data

US 2015/0061518 A1 Mar. 5, 2015

(30) Foreign Application Priority Data

Aug. 30, 2013 (TW) ..... 102131376 A

(51) Int. Cl.
*H05B 37/00* (2006.01)
*H05B 33/08* (2006.01)

(52) U.S. Cl.
CPC ..... *H05B 33/0815* (2013.01); *H05B 33/0809* (2013.01); *H05B 33/0845* (2013.01); *H05B 33/0896* (2013.01)

(58) Field of Classification Search
CPC ..... H05B 33/08
USPC ..... 315/200 R, 209 R, 290, 209 SC, 352
See application file for complete search history.

(56) References Cited

U.S. PATENT DOCUMENTS

| | | | | |
|---|---|---|---|---|
| 3,264,518 | A | 8/1966 | Stauverman | |
| 4,568,857 | A | 2/1986 | Head | |
| 4,914,558 | A | 4/1990 | Flickinger | |
| 8,053,999 | B2 * | 11/2011 | Smethurst | 315/225 |
| 8,258,710 | B2 | 9/2012 | Alexandrovich et al. | |
| 2002/0030456 | A1 * | 3/2002 | Kim | 315/307 |
| 2011/0109297 | A1 * | 5/2011 | Tosuntikool | 323/350 |
| 2012/0043892 | A1 * | 2/2012 | Visser et al. | 315/121 |
| 2012/0056554 | A1 | 3/2012 | Alexandrovich et al. | |
| 2013/0043793 | A1 * | 2/2013 | Pan | 315/127 |
| 2013/0127343 | A1 * | 5/2013 | Ge | 315/121 |

OTHER PUBLICATIONS

EP Search Report dated Feb. 20, 2015 in corresponding European application (No. 14158957.2-1802).

* cited by examiner

*Primary Examiner* — Minh D A
(74) *Attorney, Agent, or Firm* — McClure, Qualey & Rodack, LLP

(57) ABSTRACT

A light adjusting device for adjusting the luminance of a light source is provided. The light adjusting device comprises a rectifier module, a first switch element, a second switch element and a control module. The rectifier module receives an AC signal from a first power node and a second power node, and rectifies the AC signal to output a driving signal to the light source. The first switch element is coupled to the first power node. The second switch element is coupled to the second power node. The control module outputs a control signal to the first and second switch elements to control the conduction states of the first and second switch elements. When the first and second switch elements are turned on, the driving signal provided to the light source is interrupted.

15 Claims, 4 Drawing Sheets

LIGHT ADJUSTING DEVICE WITH SWITCHING ELEMENT

This application claims the benefit of Taiwan application Serial No. 102131376, filed Aug. 30, 2013, the subject matter of which is incorporated herein by reference.

BACKGROUND OF THE INVENTION

1. Field of the Invention

The invention relates in general to a light adjusting device, and more particularly to a light adjusting device incorporating a switch element to simplify circuit complexity.

2. Description of the Related Art

Conventional light source of lighting apparatus provides a steady light output at all times. However, the user can only control the light source to be either in a light state or a dark state by turning on or turning off the power, and cannot adjust the luminance of a lighting apparatus according to the scenarios of use. Most of the currently available light adjusting technologies require the use of a complicated circuit structure, not only increasing production cost but also making the installation of circuit more difficult.

Therefore, how to simplify circuit complexity and reduce production cost for light adjusting device has become a prominent task for the industries.

SUMMARY OF THE INVENTION

The invention is directed to a light adjusting device incorporating a switch element to simplify the complexity of circuit structure.

According to one embodiment of the present invention, a light adjusting device for adjusting the luminance of a light source is provided. The light adjusting device comprises a rectifier module, a first switch element, a second switch element and a control module. The rectifier module receives an AC signal from a first power node and a second power node, and rectifies the AC signal to output a driving signal to the light source. The first switch element is coupled to the first power node. The second switch element is coupled to the second power node. The control module outputs a control signal to the first and second switch elements to control the conduction states of the first and second switch elements. When the first and second switch elements are turned on, the driving signal provided to the light source is interrupted.

According to another embodiment of the present invention, a light adjusting device for rectifying the luminance of a light source is provided. The light adjusting device comprises a rectifier module, a first switch element and a second switch element. The rectifier module comprises a first diode, a second diode, a third diode and a fourth diode. The first diode is coupled between the first power node and the first node and forward biased towards the first node. One terminal of the light source is coupled to the first node. The second diode is coupled between a second power node and the first node and forward biased towards the first node. The third diode is coupled between the second power node and a second node and forward biased towards the second power node. The other terminal of the light source is coupled to the second node. The fourth diode is coupled between the first power node and the second node and forward biased towards the first power node. The first switch element is coupled between the first power node and the second node. The second switch element is coupled between the second power node and the second node. Each of the first and second switch elements has a control terminal for receiving a control signal which controls the conduction states of the first and second switch elements, and determines whether to provide a driving signal to the light source.

The above and other aspects of the invention will become better understood with regard to the following detailed description of the preferred but non-limiting embodiment(s).The following description is made with reference to the accompanying drawings.

DETAILED DESCRIPTION OF THE INVENTION

Figure 1:
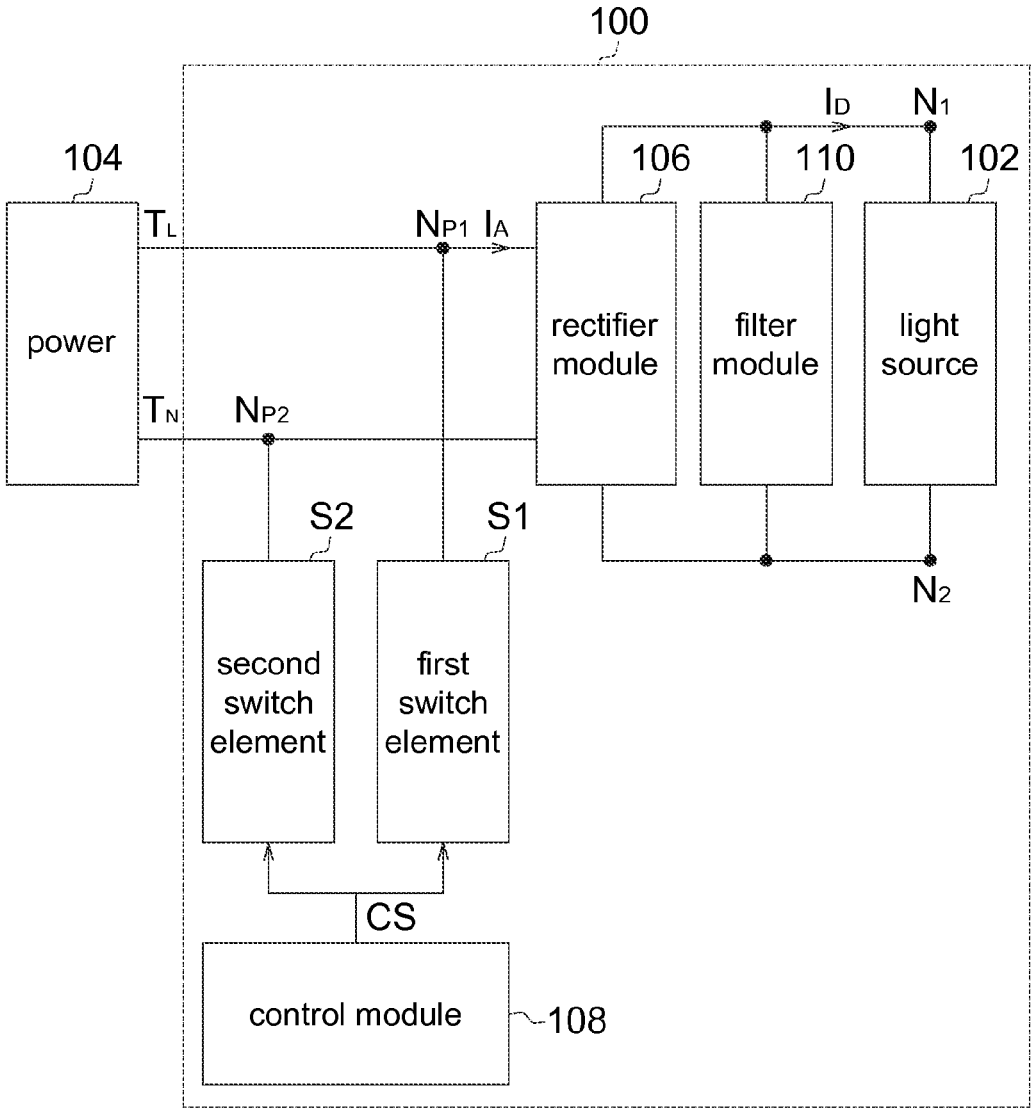
FIG. 1 is a block diagram of a light adjusting device according to an embodiment of the present invention.

Referring to FIG. 1, a block diagram of a light adjusting device 100 according to an embodiment of the present invention is shown. The light adjusting device 100 adjusts the luminance of a light source 102. As indicated in FIG. 1, the light adjusting device 100 comprises a rectifier module 106, a first switch element S1, a second switch element S2 and a control module 108. The rectifier module 106 receives an AC signal $I_A$ from a first power node $N_{P1}$ and a second power node $N_{P2}$, and further rectifies the AC signal to output a driving signal $I_D$ to the light source 102. The first switch element S1 is coupled to the first power node $N_{P1}$. The second switch element S2 is coupled to the second power node $N_{P2}$. The control module 108 outputs a control signal CS to the first and second switch elements S1 and S2 to control the conduction states of the first and second switch elements S1 and S2. When the first and second switch elements S1 and S2 are turned on, the driving signal $I_D$ provided to the light source 102 is interrupted.

The light source 102 can be realized by a light emitting diode (LED), an organic light emitting diode (OLED) or other solid-state light source. The first power node $N_{P1}$ and the second power node $N_{P2}$ are respectively coupled to a live line terminal $T_L$ and a neutral line terminal $T_N$ of a power 104 for receiving an AC signal $I_A$ from the power 104. The power 104 can be realized by an AC voltage source, a supply main, or other energy source capable of generating an AC output for a lighting apparatus. The rectifier module 106 can be realized by a full-wave rectifier capable of rectifying the AC signal $I_A$ into a DC driving signal $I_D$. The control module 108 can be realized by a pulse width modulation (PWM) signal generator capable of generating a PWM signal used as a control signal CS. However, the present invention is not limited to the above exemplifications.

As indicated in FIG. 1, one terminal of the rectifier module 106 and one terminal of the light source 102 are coupled to the first node $N_1$; the other terminal of the rectifier module 106 and the other terminal of the light source 102 are coupled to the second node $N_2$. The driving signal $I_D$ flows to the second node $N_2$ from the first node $N_1$ for enabling the light source 102 to emit a light having particular luminance and/or color temperature.

In an example, the light adjusting device 100 further comprises a filter module 110 coupled between the first node $N_1$ and the second node $N_2$ for filtering the driving signal $I_D$ to output a filtered driving signal $I_D$. The filter module 110 can be realized by a capacitor capable of low-pass filtering the driving signal $I_D$ to smooth the wave pattern of the driving signal $I_D$ (that is, the filtered driving signal $I_D$). However, the present invention is not limited to the above exemplification, and the filter module 110 can also be realized by other low-pass filters.

In the present embodiment, each of the first and second switch elements S1 and S2 has a control terminal for receiving a control signal CS from the control module 100. For instance, each of the first and second switch elements S1 and S2 can be realized by a silicon controlled rectifier (SCR) which determines whether to turn on the current in a one way manner based on the control signal CS received at the control terminal. Taking the control signal CS being a PWM signal for example, when the control signal CS is at a low level, the first and second switch elements S1 and S2 are turned off. Conversely, when the control signal CS is at a high level, the first and second switch elements S1 and S2 are turned on, and the current can flow from one terminal of the first switch element S1 or the second element S2 (such as the first power node NP1 or the second power node NP2) to the other terminal of the first switch element S1 or the second element S2 (such as the ground terminal). However, the present invention is not limited to the above exemplification, and any three-terminal elements capable of determining whether to turn on the current in a one way manner based on the received control signal can be used as the first switch element S1 or the second element S2 of the present invention embodiment.

FIG. 2A to FIG. 2D are disclosed below for elaborating the operation of the light adjusting device 100 of an embodiment of the present invention. However, the circuit structure of each module is for detailed descriptions only, not for limiting the scope of protection of the invention.

Figure 2A:
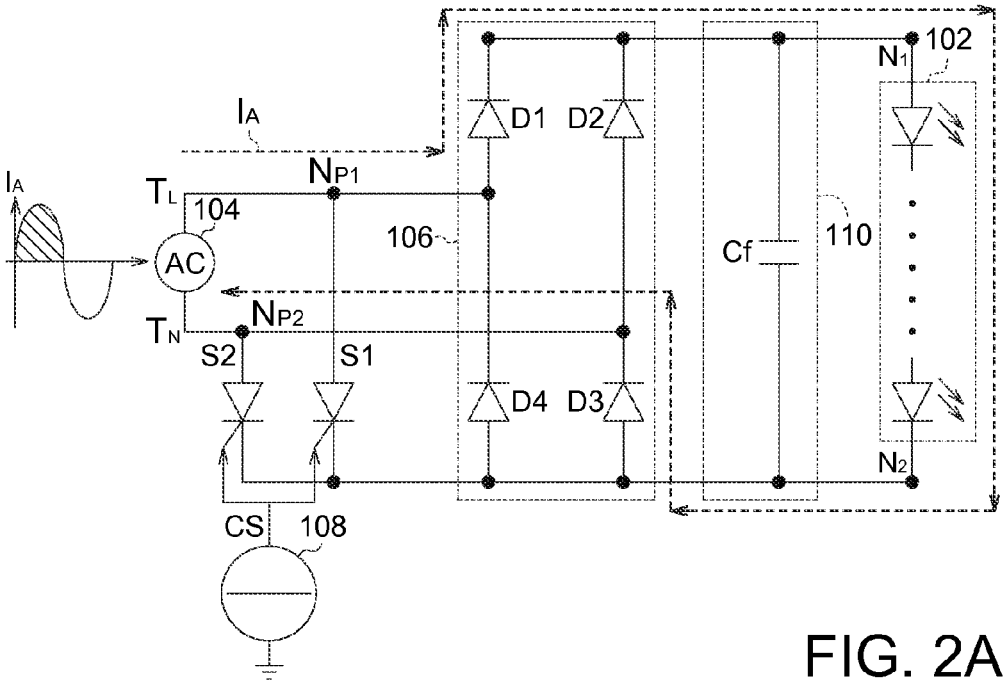
FIG. 2A is an example of a circuit diagram of a light adjusting device when first and second switch elements are turned off and the AC signal is in a positive half-cycle.

Referring to FIG. 2A, an example of a circuit diagram of a light adjusting device 100 when first and second switch elements S1 and S2 are turned off and the AC signal $I_A$ is in a positive half-cycle is shown. As indicated in FIG. 2A, the rectifier module 106 comprises a first diode D1, a second diode D2, a third diode D3 and a fourth diode D4. The first diode D1 is coupled between the first power node $N_{P1}$ and the first node $N_1$ and forward biased towards the first node $N_1$. The second diode D2 is coupled between the second power node $N_{P2}$ and the first node $N_1$ and forward biased towards the first node $N_1$. The third diode D3 is coupled between the second power node $N_{P2}$ and the second node $N_2$ and forward biased towards the second power node $N_{P2}$. The fourth diode D4 is coupled between the first power node $N_{P1}$ and the second node $N_2$ and forward biased towards the first power node $N_{P1}$. In the present example, the filter module 110 is realized by a capacitor Cf coupled between the first node $N_1$ and the second node $N_2$. Each of the first and second switch elements S1 and S2 is realized by a silicon controlled rectifier (SCR).

In the present example, the control module 108 outputs a low-level control signal CS (indicating a turn-off state) to the control terminals of the first and second switch elements S1 and S2 for turning off the first and second switch elements S1 and S2. Meanwhile, the AC signal $I_A$ at a positive half-cycle forms a power supply loop (indicated by arrows in dotted lines) along the first power node $N_{P1}$→the first diode D1 of the rectifier module 106→the light source 102→the third diode D3→the second power node $N_{P2}$, such that the light source 102 receives a full-load power supply and illuminates.

Figure 2B:
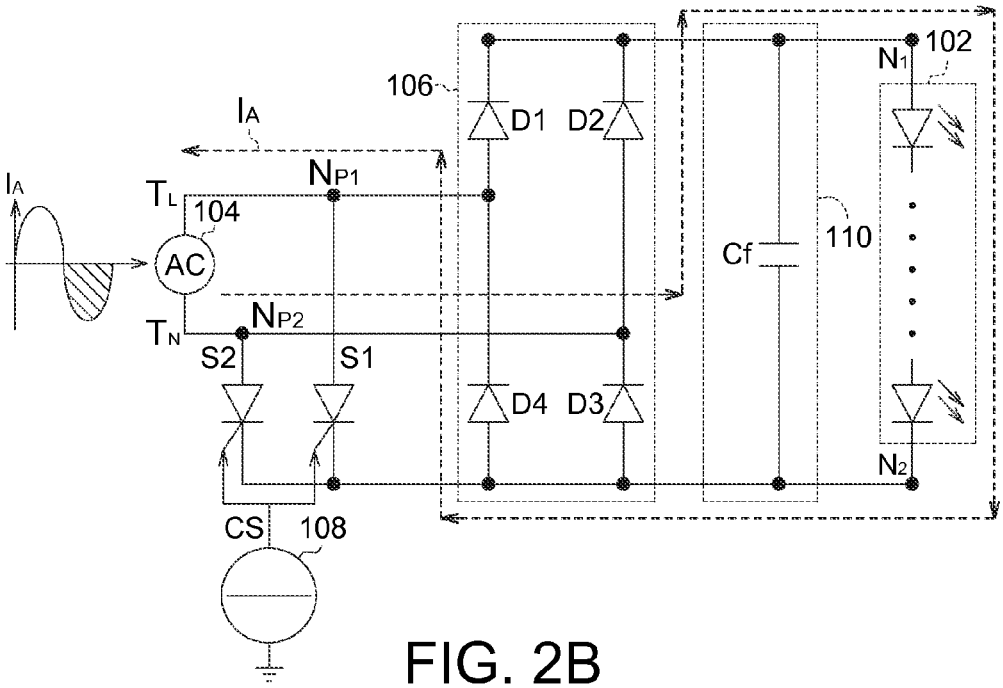
FIG. 2B is an example of a circuit diagram of a light adjusting device when first and second switch elements are turned off and the AC signal is in a negative half-cycle.

Referring to FIG. 2B, an example of a circuit diagram of a light adjusting device 100 when first and second switch elements S1 and S2 are turned off and the AC signal $I_A$ is in a negative half-cycle is shown. Like FIG. 2A, the control module 108 outputs a low-level control signal CS (indicating a turn-off state) to the control terminals of the first and second switch elements S1 and S2 for turning off the first and second switch elements S1 and S2. Meanwhile, the AC signal $I_A$ at a negative half-cycle forms a power supply loop (indicated by arrows in dotted lines) along the second power node $N_{P2}$→the second diode D2 of the rectifier module 106→the light source 102→the fourth diode D4→the first power node $N_{P1}$, such that the light source 102 receives a full-load power supply and illuminates.

Figure 2C:
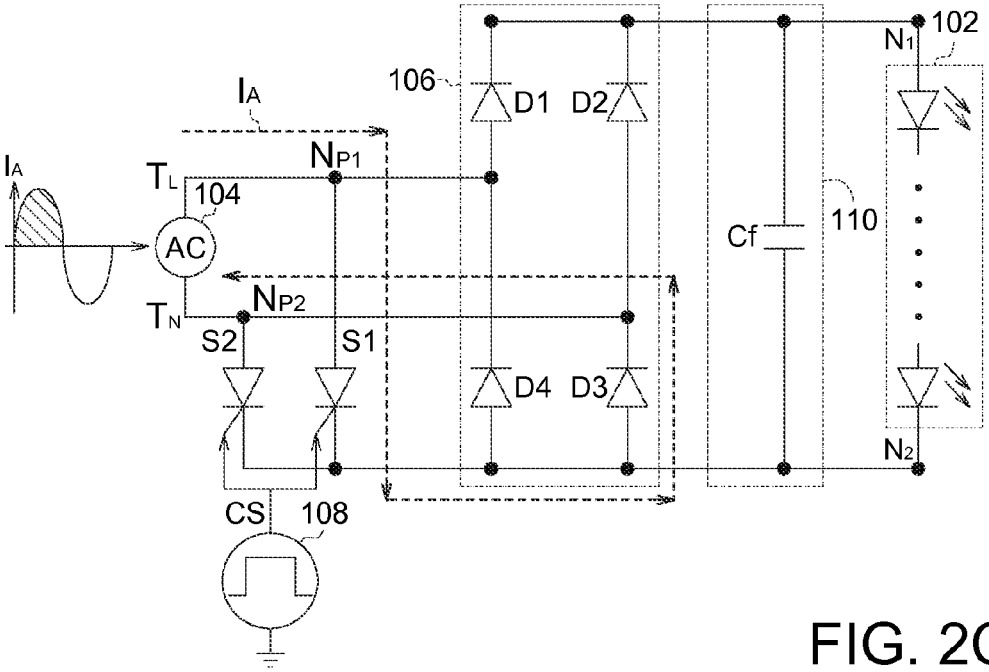
FIG. 2C is an example of a circuit diagram of a light adjusting device when first and second switch elements are turned on and the AC signal is in a positive half-cycle.

Referring to FIG. 2C, an example of a circuit diagram of a light adjusting device 100 when first and second switch elements S1 and S2 are turned on and the AC signal $I_A$ is in a positive half-cycle is shown. In the present example, the control module 108 outputs a high-level control signal CS (indicating a turn-on state) to the control terminals of the first and second switch elements S1 and S2 for turning on the first and second switch elements S1 and S2. Meanwhile, the AC signal $I_A$ at a positive half-cycle forms a loop current (indicated by arrows in dotted lines) along the first power node $N_{P1}$→the first switch element S1→the third diode D3 of the rectifier module 106→the second power node $N_{P2}$. Since the loop current does not flow through the light source 102, the power supply of the light source 102 will be terminated during the positive half-cycle.

Figure 2D:
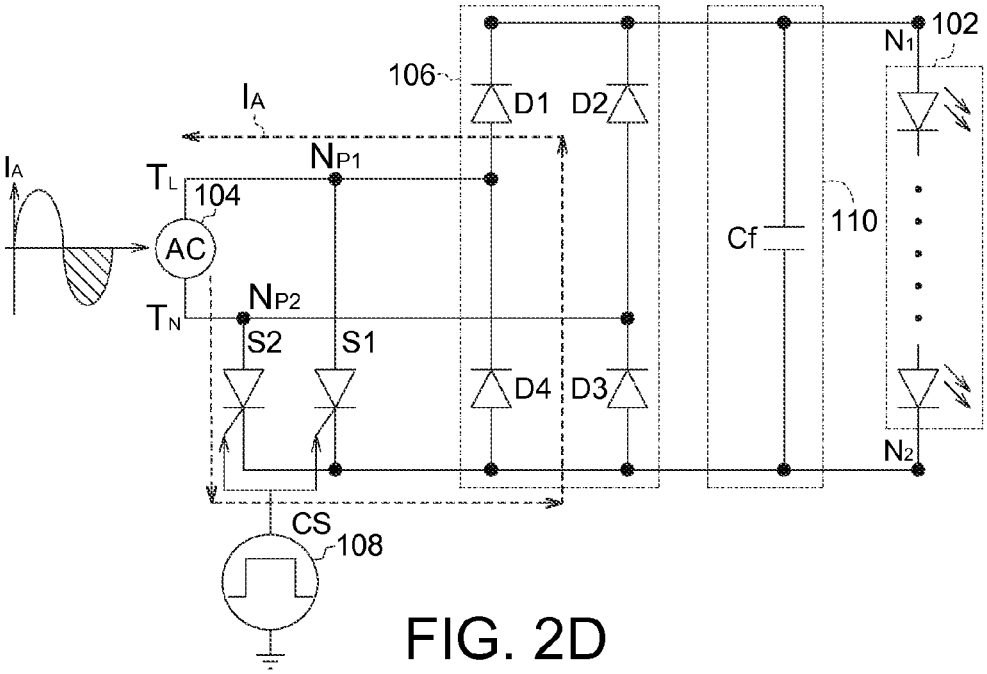
FIG. 2D is an example of a circuit diagram of a light adjusting device when first and second switch elements are turned on and the AC signal is in a negative half-cycle.

Referring to FIG. 2D, an example of a circuit diagram of a light adjusting device 100 when first and second switch elements S1 and S2 are turned on and the AC signal $I_A$ is in a negative half-cycle is shown. Like FIG. 2C, the control module 108 outputs a high-level control signal CS (indicating a turn-on state) to the control terminals of the first and second switch elements S1 and S2 for turning of the first and second switch elements S1 and S2. Meanwhile, the AC signal $I_A$ at a negative half-cycle forms a loop current (indicated by arrows in dotted lines) along the second power node $N_{P2}$→the second switch element S2→the fourth diode D4 of the rectifier module 106→the first power node $N_{P1}$. Since the loop current does not flow through the light source 102, the power supply of the light source 102 will be terminated during the negative half-cycle.

Figure 3A:
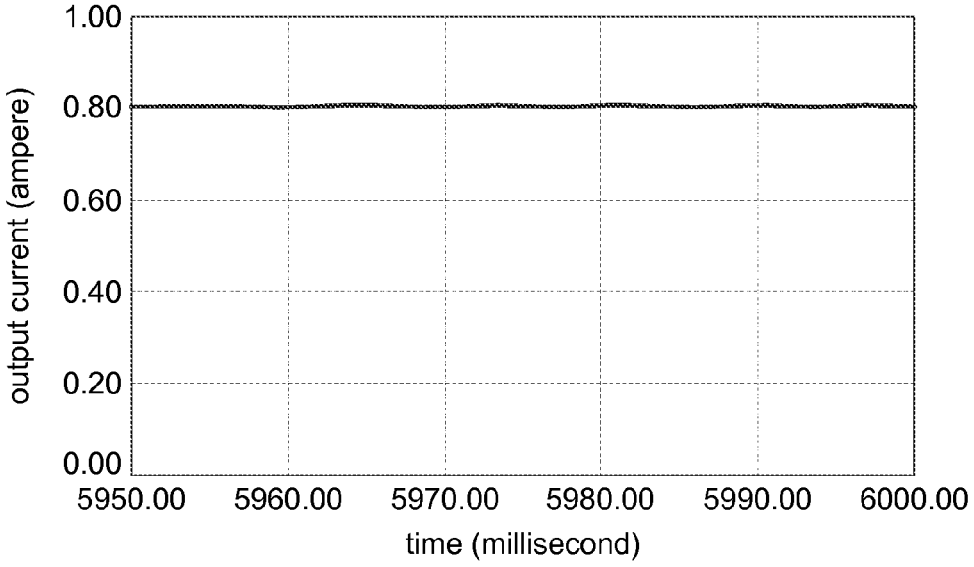
FIG. 3A is a measurement chart of output current of a light source when the duty cycle of a control signal is at 0%.
Figure 3B:
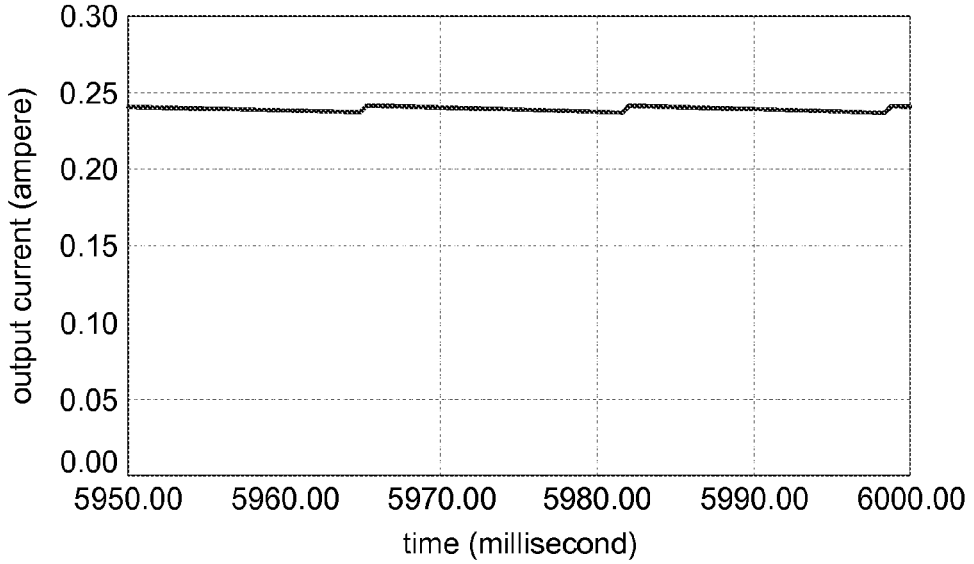
FIG. 3B is a measurement chart of output current of a light source when the duty cycle of a control signal is at 90%.

Referring to FIG. 3A and FIG. 3B, measurement charts of output current of a light source 102 (exemplified by an LED string) when duty cycle of control signal CS is at 0% and 90% respectively are shown. As indicated in FIG. 3A, when the duty cycle of the control signal CS is equal to 0%, this indicates that the first and second switch elements S1 and S2 are turned off (or not operating). Meanwhile, when the output current of the light source 102 is about 0.8 ampere, this indicates that the light source 102 is operated at full load. Conversely, as indicated in FIG. 3B, when the duty cycle of the control signal CS is equal to 90%, this indicates that the first and second switch elements S1 and S2 are turned on (or are operating). Meanwhile, the output current of the light source 102 is about 0.24 ampere, which deteriorates the luminance of the light source 102. The working conditions and measurement results are for verifying the effect of the light adjusting device 100 of disclosed embodiments of the present invention, not for limiting the scope of protection of the present invention.

The light adjusting device of disclosed embodiments of the present invention achieves the effect of adjusting the light source by controlling the conduction states of the first and second switch elements coupled to the power, not only largely simplifying circuit complexity but also reducing production cost and manufacturing labor.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A light adjusting device for rectifying the luminance of a light source, comprising:

a full-wave bridge rectifier for receiving an AC signal from a first power node and a second power node, and rectifying the AC signal to output a driving signal to the light source;

a first switch element coupled to the first power node;

a second switch element coupled to the second power node; and a pulse width modulation (PWM) signal generator for outputting a control signal to the first and second switch elements to control the conduction states of the first and second switch elements, wherein the first and second switch elements are turned off when the control signal is at a low level, and the first and second switch elements are turned on when the control signal is at a high level;

wherein, when the first and second switch elements are turned on, the driving signal provided to the light source is interrupted;

wherein one terminal of the full-wave bridge rectifier and one terminal of the light source are coupled to a common first node, the other terminal of the full-wave bridge rectifier and the other terminal of the light source are coupled to a common second node, the driving signal flows to the common second node from the common first node, and the first and second switch elements are coupled to the common second node.

2. The light adjusting device according to claim 1, wherein the first and second power node are respectively coupled to a live line terminal and a neutral line terminal of a power.

3. The light adjusting device according to claim 1, wherein each of the first and second switch elements has a control terminal for receiving the control signal from the PWM signal generator.

4. The light adjusting device according to claim 1, wherein the first and second switch elements is a silicon controlled rectifier (SCR).

5. The light adjusting device according to claim 1, wherein when the control signal makes the first and second switch elements turned on and the AC signal is in a positive half-cycle, the light adjusting device forms a loop current flowing through the first switch element and the full-wave bridge rectifier.

6. The light adjusting device according to claim 1, wherein when the control signal makes the first and second switch elements turned on and the AC signal is in a negative half-cycle, the light adjusting device forms a loop current flowing through the second switch element and the full-wave bridge rectifier.

7. The light adjusting device according to claim 1, further comprising:

a filter module coupled between the common first node and the common second node for filtering the driving signal to output a filtered driving signal.

8. A light adjusting device for rectifying the luminance of a light source, comprising:

a rectifier module, comprising:

a first diode coupled between a first power node and a first node and forward biased towards the first node, wherein one terminal of the light source is coupled to the first node;

a second diode coupled between a second power node and the first node and forward biased towards the first node;

a third diode coupled between the second power node and a second node and forward biased towards the second power node, wherein the other terminal of the light source is coupled to the second node; and a fourth diode coupled between the first power node and the second node and forward biased towards the first power node;

a first switch element coupled between the first power node and the second node; and a second switch element coupled between the second power node and the second node;

wherein, each of the first and second switch elements has a control terminal for receiving a control signal, which controls the conduction states of the first and second switch elements and determines whether to provide a driving signal to the light source.

9. The light adjusting device according to claim 8, wherein the first and second power node are respectively coupled to a live line terminal and a neutral line terminal of a power.

10. The light adjusting device according to claim 8, wherein each of the first and second switch elements is a silicon controlled rectifier (SCR).

11. The light adjusting device according to claim 8, wherein the light adjusting device receives an AC signal from the first power node and the second power node;

when the AC signal is in a positive half-cycle and the control signal makes the first and second switch elements turned on, the light adjusting device forms a loop current flowing the first switch element and the third diode.

12. The light adjusting device according to claim 8, wherein the light adjusting device receives an AC signal from the first power node and the second power node;

when the AC signal is in a negative half-cycle and the control signal makes the first and second switch elements turned on, the light adjusting device forms a loop current flowing through the second switch element and the fourth diode.

13. The light adjusting device according to claim 8, wherein the light adjusting device receives an AC signal from the first power node and the second power node;

when the AC signal is in a positive half-cycle and the control signal makes the first and second switch elements turned off, the light adjusting device forms the driving signal flowing through the first diode, the light source and the third diode.

14. The light adjusting device according to claim 8, wherein the light adjusting device receives an AC signal from the first power node and the second power node;

when the AC signal is in a negative half-cycle and the control signal makes the first and second switch elements turned off, the light adjusting device forms the driving signal flowing through the second diode, the light source and the fourth diode.

15. The light adjusting device according to claim 8, further comprising:

a filter module coupled between the first node and the second node for filtering the driving signal to output a filtered driving signal.

* * * * *